US005395499A

United States Patent [19]

Matyi et al.

[11] Patent Number: 5,395,499

[45] Date of Patent: Mar. 7, 1995

[54] ELECTROFORMING MANDRELS

[75] Inventors: Ernest F. Matyi, Webster; William G. Herbert, Williamson; Gary J. Maier; Loren E. Hendrix, both of Webster, all of N.Y.

[73] Assignee: Xerox Corporation, Stamford, Conn.

[21] Appl. No.: 61,149

[22] Filed: May 14, 1993

[51] Int. Cl.[6] ..... C25D 1/02

[52] U.S. Cl. ..... 204/193; 205/67; 205/70; 205/73

[58] Field of Search ..... 204/193; 205/67, 70, 205/73

[56] References Cited

U.S. PATENT DOCUMENTS

| | | | |
|---|---|---|---|
| 4,501,646 | 2/1985 | Herbert | 204/4 |
| 4,549,939 | 10/1985 | Kenworthy et al. | 204/4 |
| 4,711,833 | 12/1987 | McAneney et al. | 430/131 |
| 4,781,799 | 11/1988 | Herbert, Jr. et al. | 204/9 |
| 4,902,386 | 2/1990 | Herbert et al. | 204/9 |
| 5,021,109 | 6/1991 | Petropoulos et al. | 156/137 |
| 5,064,509 | 11/1991 | Melnyk et al. | 204/9 |
| 5,230,787 | 7/1993 | Cherian et al. | 205/67 |

FOREIGN PATENT DOCUMENTS

| | | | |
|---|---|---|---|
| 0250781 | 8/1969 | U.S.S.R. | 205/73 |

*Primary Examiner*—John Niebling
*Assistant Examiner*—Arun S. Phasge
*Attorney, Agent, or Firm*—Zosan S. Soong

[57] ABSTRACT

An at least partially hollow electroforming mandrel containing therein means for adjustably altering the diameter of the mandrel. The mandrel assists in creating a parting gap between the mandrel and the electroformed article, thereby facilitating separation of the two components.

11 Claims, 2 Drawing Sheets

ELECTROFORMING MANDRELS

This invention relates generally to electroforming mandrels and more particularly to mandrels which incorporate devices for changing the mandrel diameter to facilitate the separation of the electroformed article from the mandrel.

To facilitate separation, there are conventionally selected materials for the electroformed article and the mandrel with different thermal coefficients of expansion. After the electroformed article is deposited on the mandrel, the composite structure is then cooled or heated, wherein the electroformed article contracts or expands at a different rate or to a different extent from the mandrel, thereby effecting a parting gap. There is a need for new methods and equipment for creating a parting gap, including those methods and apparatus which do not need to rely on a difference in thermal coefficients of expansion between the electroformed article and the mandrel. These methods and apparatus would be advantageous since the same material could be used for the mandrel and the electroformed article.

The following documents may be of interest:

Herbert et al., U.S. Pat. No. 4,902,386, discloses a mandrel having an ellipsoid shaped end.

Herbert, U.S. Pat. No. 4,501,646, discloses an electroforming process which effects a parting gap by heating or cooling.

Petropoulous et al., U.S. Pat. No. 5,021,109, discloses devices and methods to facilitate removal of a tubular sleeve from a mandrel, reference for example, col. 11.

Melnyk et al., U.S. Pat. No. 5,064,509, discloses devices and methods to faciliate removal of an electroformed article from a mandrel, reference, cols. 12–13.

McAneney et al., U.S. Pat, No. 4,711,833, discloses air assisted removal of substrates from a mandrel, reference for example, col. 10, lines 30–40.

Kenworthy et al., U.S. Pat. No. 4,549,939, discloses the removal of an electroformed part from a photomask mandrel by a variety of ways, reference, for example, col. 3.

Herbert et al., U.S. Pat. No. 4,781,799, discloses an elongated electroforming mandrel, the mandrel comprising at least a first segment having at least one mating end and a second segment having at least one mating end, the mating end of the first segment being adapted to mate with the mating end of the second segment.

SUMMARY OF THE INVENTION

It is an object of the present invention to effect a parting gap between a mandrel and an article formed thereon by expanding or shrinking the mandrel diameter.

It is a further object in embodiments to use materials for the mandrel and the electroformed article having the same or similar coefficients of expansion.

It is another object in embodiments to effect a parting gap by adjustably altering the mandrel diameter.

It is still a further object in embodiments to provide apparatus internal to the mandrel which effects changes in the mandrel diameter.

These objects and others are accomplished in embodiments by providing an electroforming mandrel comprising: (a) a partially or entirely hollow mandrel; and (b) means for altering the diameter of the mandrel along at least a portion of the length thereof, wherein at least a portion of the diameter altering means is positioned within the hollow portion of the mandrel.

These objects and others are also accomplished in embodiments by providing a method for facilitating the separation of an electroformed article from a partially or entirely hollow mandrel comprising: (a) expanding the diameter of the mandrel; (b) electroforming the electroformed article on the mandrel with the expanded diameter; and (c) shrinking the mandrel diameter, thereby creating a gap between at least a portion of the electroformed article and the mandrel.

These objects and others are further accomplished in embodiments by providing a method for facilitating the separation of an electroformed article from a mandrel comprising: (a) providing a partially or entirely hollow mandrel having a first end and a closed or partially closed second end with an inner surface, wherein the mandrel possesses walls of an effective thinness to permit elongation of the mandrel due to pressure exerted against the inner surface of the second end; (b) electroforming the electroformed article on the mandrel; and (c) pressing against the inner surface of the second end which elongates the mandrel, thereby decreasing the mandrel diameter and creating a gap between at least a portion of the electroformed article and the mandrel.

BRIEF DESCRIPTION OF THE DRAWINGS

Other aspects of the present invention will become apparent as the following description proceeds and upon reference to the Figures, which represent preferred embodiments.

DETAILED DESCRIPTION

The mandrel includes any suitable apparatus for changing the diameter of the mandrel along at least a portion of the length thereof to facilitate electroform removal. The length of the mandrel having the changed diameter may be the entire length, but typically is less than the entire length. A portion of the mandrel having a changed diameter less than the entire length may range for example from about 1/5 to about $\frac{3}{4}$ the length of the mandrel. The diameter change is temporary in embodiments since it is desired to reuse the mandrel after removal of the electroform. In embodiments, the mandrels may be fitted with the materials and devices disclosed herein either prior to or subsequent to electroforming.

Figure 1:
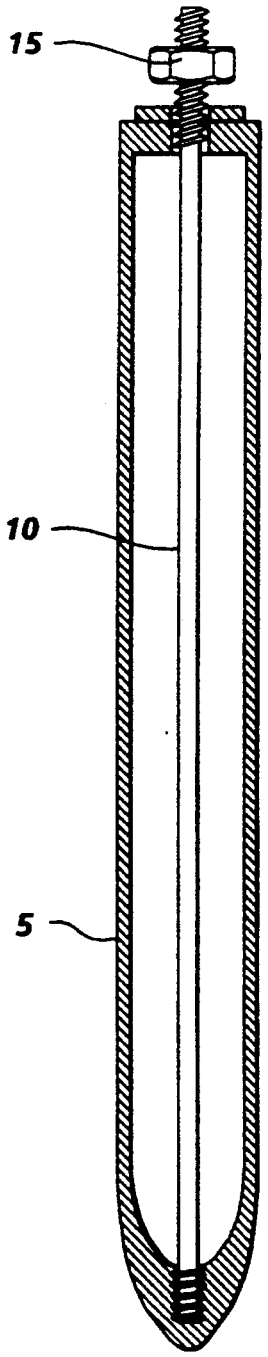
FIG. 1 is a schematic illustration of a cross section of a mandrel employing a tierod and a nut to alter the mandrel diameter.
Figure 2:
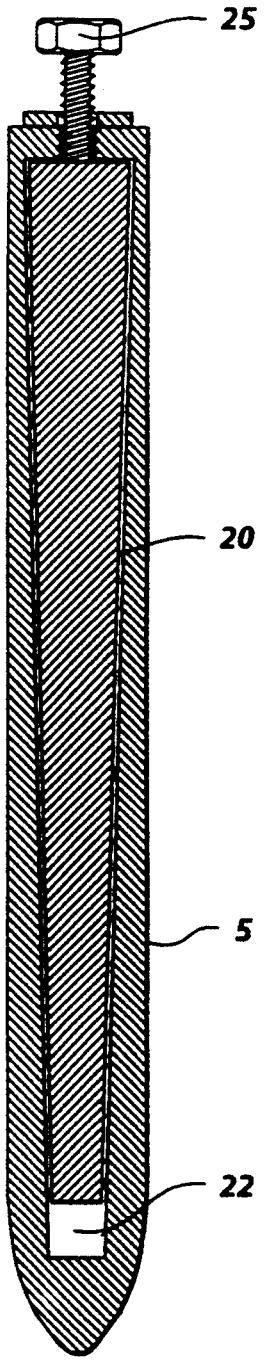
FIG. 2 is a schematic illustration of a cross section of a mandrel employing a tapered component and a screw to alter the mandrel diameter.
Figure 3:
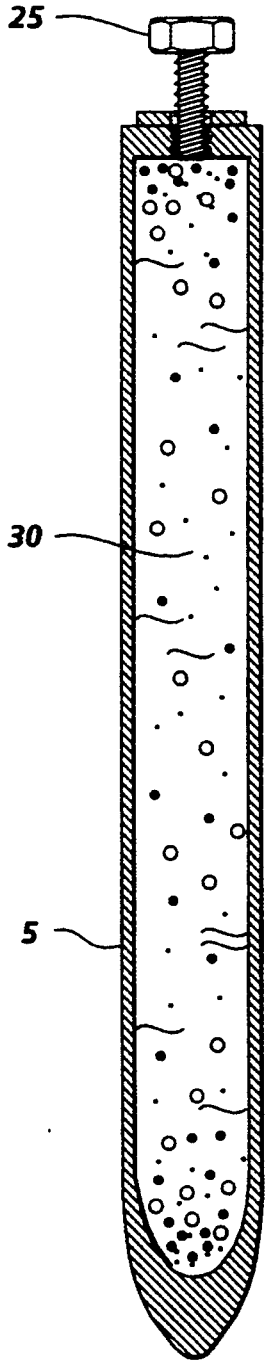
FIG. 3 is a schematic illustration of a cross section of a mandrel employing a displaceable material and a screw to alter the mandrel diameter.

FIGS. 1, 2, and 3 disclose embodiments which employ the following to facilitate electroform removal. The diameter of the mandrel is expanded along at least a portion of the length thereof, and preferably the entire length. The diameter is expanded by an amount effective for the eventual creation of a parting gap, preferably expanding the diameter by about 1 mm to about 5 cm, and more preferably about 2 mm to about 3 cm. In a preferred embodiment, a portion of the mandrel is expanded from a diameter of 10 cm to a diameter of about 12 cm. Subsequently the electroform article is deposited on the mandrel having the expanded diameter. The mandrel diameter is maintained at the expanded diameter as long as necessary and for an effective period of time to deposit the electroformed article on the mandrel. After electroforming, the expanded portion of the mandrel diameter is shrunk to a value effective for creating a parting gap such as for example the original diameter. In embodiments, the mandrel is shrunk to a value between the original diameter and the expanded diameter such as from about 0.5 mm to about 1 cm greater than the original diameter. Shrinking the mandrel diameter creates a gap between at least a portion of the electroformed article and the mandrel.

In FIG. 1, mandrel 5 is hollow and contains therein tierod 10 which is fixedly attached on one end to the parabolic end of mandrel 5. The other end of tierod 10 extends through the end of mandrel 5 and is coupled to nut 15. Tierod 10 is optionally threaded at one or both ends. To expand the mandrel diameter, nut 15 is tightened which draws the ends of mandrel 5 towards one another, akin to pressing the ends of a marshmellow with thumb and forefinger which puffs out its sides. Typically as long as nut 15 is not loosened, mandrel 5 has the expanded diameter. Loosening nut 15 to an appropriate extent reduces the stress on the mandrel ends and returns the mandrel to its original diameter or a slightly increased diameter.

In FIG. 2, mandrel 5 has a tapered hollow chamber which snugly accommodates therein tapered component 20 which is separated from the inner surface of the mandrel end by gap 22. The bottom of screw 25 contacts the wider end of tapered component 20. To expand the mandrel diameter, screw 25 is tightened which pushes down on tapered component 20 and moves it into gap 22. Movement of tapered component 20 causes its sides to push against the inner side surfaces of the mandrel, thereby increasing the mandrel diameter. Typically as long as screw 25 is not loosened, mandrel 5 has the expanded diameter. Loosening screw 25 to an appropriate extent allows tapered component 20 to rise, thereby decreasing the pressure against the inner surfaces of the mandrel and allowing the mandrel to return to its original diameter or a slightly increased diameter. Gap 22 may be of any effective size, preferably separating the tapered component from the inner surface of the mandrel end in the unstressed condition by about 5 mm to about 10 cm, and more preferably about 10 mm to about 5 cm.

In FIG. 3, mandrel 5 is hollow and is filled with displaceable material 30. Screw 25 is positioned at one end of mandrel 5. To expand the mandrel diameter, screw 25 is tightened and it displaces an amount of displaceable material 30 as screw 25 descends. The pressure of displaceable material 30 against the inner surfaces of mandrel 5 increases as screw 25 progresses inward and such pressure can expand the mandrel diameter. Typically providing that screw 25 is not loosened, i.e., turned outward, mandrel 5 has the expanded diameter. Loosening screw 25 to an appropriate extent allows displaceable material 30 to return to fill the space formerly occupied by screw 25, thereby decreasing the pressure against the inner surfaces of the mandrel and allowing the mandrel to return to its original diameter or a slightly increased diameter. In embodiments, screw 25 presses down on a plate atop displaceable material 30. Employing a plate may compress displaceable material 30 in a more uniform manner and provides additional mechanical advantage of allowing more displacement of material 30 per unit advance of screw 25.

The phrase displaceable material refers to any suitable substance wherein its volume may be displaced. In embodiments, the displaceable material fills the entire hollow portion of the mandrel. Displaceable materials may be for example any suitable liquid such as water, oil, glycol such as polyethylene glycol, and the like; gas such as nitrogen, oxygen, carbon dioxide, a mixture of gases such as air, 20% oxygen and 80% nitrogen by weight, or mixtures of gas and liquid. Solids which soften or liquify at elevated temperatures of for example 80 to about 200° C. may also be used, including thermoplastics such as rubbers, waxes, nylons, polyurethane, polystyrene, and cellulosic and acrylic resins.

FIGS. 1–3 disclose nuts and screws as preferred tightening devices, but it is understood that any suitable tightening device, preferably adjustable, may be used. The term adjustable means that the device can be loosened and tightened, depending on the desired situation. The torque that may be applied to tighten the screw/nut to increase the mandrel diameter to desired size depends on the size of the mandrel and the materials of construction. Typical torque values range from about 1 to about 100 foot pound.

Figure 4:
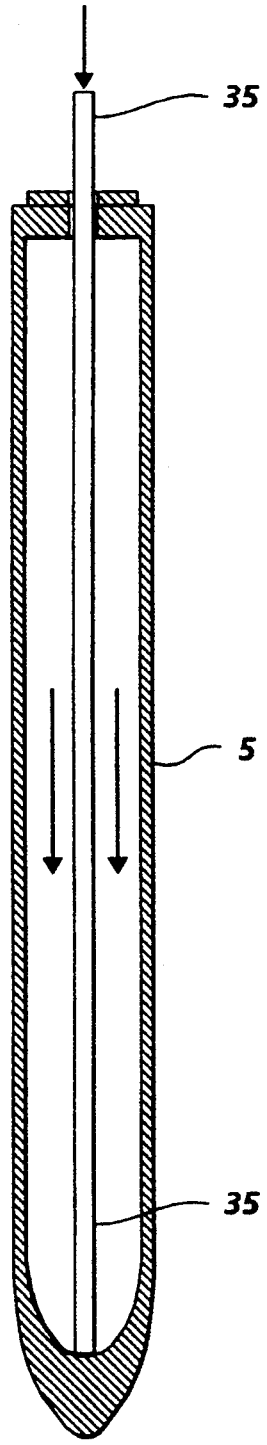
FIG. 4 is a schematic illustration of a cross section of a mandrel employing a pressing device to alter the mandrel diameter.

FIG. 4 discloses an embodiment which decreases the diameter of the mandrel along at least a portion of the length thereof, and preferably the entire length, to facilitate electroform removal. Mandrel 5 is hollow and contains pressing device 35 which may be any suitable apparatus for pressing against the inner surface of the parabolic end of mandrel 5 and can be for example a hollow or solid rod. The electroformed article is then deposited on the mandrel. Preferably after electroforming, force is exerted on pressing device 35 to cause it to press against the inner surface of the parabolic end of mandrel 5. This interior pressure exerted against the parabolic end of mandrel 5 increases the length of mandrel 5, thereby decreasing the mandrel diameter and creating a gap between at least a portion of the electroformed article and the mandrel. The mandrel diameter may be decreased to an extent effective for effecting a parting gap, preferaby decreasing the diameter by about 1 mm to about 5 cm, and more preferably by about 2 mm to about 3 cm. In an embodiment, the mandrel diameter is decreased from a diameter of about 8 cm to a diameter of about 7 cm. Force is exerted on the pressing device by any suitable method including air pressure, hydraulics, or mechanical pressure such as a lever. In embodiments, the pressing device may comprise two or more components such as a rod contained within a sleeve having a closed end. In such a combination, the rod would press against the sleeve, which in turn would exert force against the parabolic end of the mandrel. An effective force is exerted on the pressing device, preferably of about 50 to about 5000 Newtons, and more preferably 100 to 1000 Newtons.

In FIGS. 1–4, the mandrel diameter may be changed to a precisely controlled diameter by employing any suitable technique including one or more of the following: direct diameter measurement reading that terminates the turning of the screw/nut or the force on the pressing device when the desired diameter is reached (by employing for example an air or electronic gauge; measurement of the torque of the screw/nut (by employing for example a torque wrench or a stress strain gauge) or measurement of the force on the pressing device (by employing for example a pressure gauge when the pressing device is illustratively an air or hydraulic cylinder); and sizing the gap and/or the narrower end of the tapered component in FIG. 2 such that the tapered component touches the inner surface of the mandrel end at a desired mandrel diameter, i.e., the tapered component "bottoms out."

An effective parting gap is produced by the present invention along the entire length of the mandrel or portions thereof. Preferably the parting gap ranges from about 0.1 mm to about 1 cm, and more preferably from about 0.1 mm to about 5 mm in width separating the electroform and the mandrel.

In embodiments of the present invention, the mandrel is of any effective design and is partially hollow, preferably hollow along about $\frac{1}{4}$ to about $\frac{3}{4}$ its length, and more preferably entirely hollow. The mandrel may have partially closed ends, one of which is preferably closed. In embodiments, the mandrel is cylinder, optionally with tapered sides. Although the mandrel may have flat or nearly flat ends, which are closed or partially closed, it is preferred that at least one end has a tapered shape, particularly an ellipsoid shaped end, with the mandrel profile preferably like that illustrated in Herbert et al., U.S. Pat. No. 4,902,386, the disclosure of which is totally incorporated by reference. The mandrel may be of any suitable dimensions. For example, the mandrel may have a length ranging from about 5 cm to about 100 cms; and an outside diameter ranging from about 5 cm to about 30 cm. The mandrel possesses sidewalls and ends of an effective thinness to permit changes in the mandrel diameter by the methods disclosed herein including for example sidewalls and ends having a thickness ranging from about 0.5 mm to about 5 cm, and preferably from about 1 mm to about 1 cm. The mandrel may be fabricated from any suitable material, preferably a metal such as aluminum, nickel, steel, iron, copper, and the like.

Although FIGS. 1–4 disclosed embodiments having mandrels with closed ends, it is understood that mandrels with partially closed ends may be employed. For example, the embodiments disclosed in FIGS. 1–4 may be modified so that the mandrels have an opening at the apex of the tapered end. With such a modification, the following adaptations may occur: In modified FIG. 1, one end of the tierod may be for example welded or coupled to the a portion of the tapered end adjacent the opening. In modified FIG. 2, the tapered component may be for example sized so that its narrower end is wider than the opening in the tapered mandrel end. In modified FIG. 3, a metal plug may be for example inserted into the opening to seal it off. In modified FIG. 4, the pressing device may be for example sized so that its end pressing against the tapered mandrel end is wider than the opening.

In embodiments, open ended mandrels may be employed. In such situations, the open ends of the mandrels may be, for example, closed by coupled end pieces, preferably made of a metal such as aluminum, such that the apparatuses and methods disclosed herein may be used.

The mandrel diameter changing devices such as the nut, tierod, screw, tapered component, pressing device and equivalent components may be of any effective shape, size and material. Preferred materials include wood; metals such as steel, copper, nickel, iron, aluminum; and plastics such as nylons and polycarbonates. The tierod and pressing device may be hollow or solid, rod shaped, with cylindrical, square, or rectangular cross sections. The tapered component has an effective taper, and preferably a taper of about 0.1 mm to about 1 mm per mm of tapered component length.

An optional hole or slight depression at the end of the mandrel is desirable to function as a bleeding hole to facilitate more rapid removal of the electroformed article from the mandrel. The bleed hole prevents the deposition of metal at the apex of the tapered end of the mandrel during the electroforming process so that ambient air may enter the space between the mandrel and the electroformed article during removal of the article subsequent to electroforming. The bleed hole should have sufficient depth and circumference to prevent hole blocking deposition of metal during electroforming. For small diameter mandrel having an outside diameter between about 1/16 inch (0.2 mm) and about 2.5 inches (63.5 mm) a typical dimension for bleed hole depth ranges from about 3 mm to about 14 mm and a typical dimension for circumference ranges from about 5 mm and about 15 mm. Other mandrel diameters such as those greater than about 63.5 mm may also utilize suitable bleed holes having dimensions within and outside these depth and circumference ranges.

The mandrel may be optionally plated with a protective coating. The plated coating is generally continuous except for areas that are masked or to be masked and may be of any suitable material. Typical plated protective coatings for mandrels include chromium, nickel, alloys of nickel, iron, and the like. The plated metal should preferably be harder than the metal used to form the electroform and is of an effective thickness of for example at least 0.006 mm in thickness, and preferably from about 0.008 to about 0.05 mm in thickness. The outer surface of the plated mandrel preferably is passive, i.e., adhesive, relative to the metal that is electrodeposited to prevent adhesion during electroforming. Other factors that may be considered when selecting the metal for plating include cost, nucleation, adhesion, oxide formation and the like. Chromium plating is a preferred material for the outer mandrel surface because it has a naturally occurring oxide and surface resistive to the formation of a strongly adhering bond with the electro-deposited metal such as nickel. However, other suitable metal surfaces could be used for the mandrels. The mandrel may be plated using any suitable electrodeposition process. Processes for plating a mandrel are known and described in the patent literature. For example, a process for applying multiple metal platings to an aluminum mandrel is described in U.S. Pat. Nos. 4,067,782, and 4,902,386, the disclosures of which are totally incorporated by reference.

Articles may be formed on the plated mandrels of this invention by any suitable electroforming process. Processes for electroforming articles on the mandrel are also well known and described, for example, in U.S. Pat. Nos. 4,501,646 and 3,844,906, the disclosures of which are totally incorporated by reference. The electroforming process of this invention may be conducted in any suitable electroforming device. For example, a plated cylindrically shaped mandrel having an ellipsoid shaped end may be suspended vertically in an electroplating tank. The electrically conductive mandrel plating material should be compatible with the metal plating solution. For example, the mandrel plating may be chromium. The top edge of the mandrel may be masked off with a suitable non-conductive material, such as wax to prevent deposition. The electroplating tank is filled with a plating solution and the temperature of the plating solution is maintained at the desired temperature. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source. In operation, the mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank.

The deposited metal article preferably does not adhere to the plated metal coating on the mandrel core because the coating may be selected from a passive material. Consequently, as a parting gap is formed between the mandrel and the electroformed metal article by the methods and apparatuses disclosed herein, the electroformed metal article may be readily slipped off the mandrel.

Any suitable method and apparatus may be employed to assist in the removal of the electroformed article from the mandrel. For example, a mechanical parabolic end parting fixture may be employed to grasp the preferably parabolic shaped end of the electroform after the parting gap has been established. The grasping jaws may have as few as three fingers or may completely contact the electroform circumference like a lathe collet. Alternatively, a vacuum cup may be placed under the preferably parabolic shaped end of the mandrel. A vacuum would be generated by the use of air pressure or vacuum pump. In another approach, the electroform/mandrel composite structure is inserted into an induction coil and by energizing the coil the electroform is heated and consequently enlarges, thereby loosening it from the mandrel. In a different approach, vibrational energy, especially ultrasonic energy, is used to cause the electroform to separate from the mandrel. In one embodiment, an ultrasonic bath is used during or after the parting gap is established to assist in removal of the electroform. It is also possible to use a vibrator which contacts the electroform or the mandrel. In the removal methods described herein, axial force, rotational force, or a combined force may be applied to the mandrel and/or the electroformed article to facilitate separation.

Other modifications of the present invention may occur to those skilled in the art based upon a reading of the present disclosure and these modifications are intended to be included within the scope of the present invention.

We claim:

1. A mandrel comprising:

(a) a member defining a chamber, wherein the member has a first end and a second end; and (b) diameter altering means for drawing the first end and the second end toward one another, thereby increasing the diameter of the member along at least a part of the length thereof, wherein the diameter altering means is at least partially disposed within the chamber.

2. The mandrel of claim 1, wherein the diameter altering means comprises a tie rod fixedly coupled on one end to the second end of the member and a tightening device coupled to the other end of the tie rod.

3. The mandrel of claim 2, wherein the tightening device comprises a nut.

4. A mandrel comprising:

(a) a member defining a chamber, wherein the member has a first end and a second end, wherein the second end defines an inner surface;

(b) a tapered component at least partially disposed within the chamber, the thinner end of the tapered component is separated by a gap from the inner surface of the second end; and (c) a tightening device positioned adjacent the thicker end of the tapered component.

5. The mandrel of claim 4, wherein the tightening device comprises a screw.

6. A mandrel comprising:

(a) a member defining a chamber;

(b) a displaceable material which fills at least a part of the chamber; and (c) a volume displacement device adapted for movement into the chamber.

7. The mandrel of claim 6, wherein the displaceable material is a liquid, gas, thermoplastic solid or a mixture thereof.

8. The mandrel of claim 6, wherein the displaceable material is water, oil, glycol, or polyurethane.

9. The mandrel of claim 6, wherein the volume displacement device comprises a screw.

10. A mandrel comprising:

(a) a member defining a chamber, wherein the member has a first end and a second end, wherein the second end defines an inner surface; and (b) a pressing device at least partially positioned in the chamber and adapted for engagement against the inner surface of the second end.

11. The mandrel of claim 10, wherein the pressing devices comprises a rod.

* * * * *